United States Patent [19]

Arnault

[11] 4,331,109

[45] May 25, 1982

[54] PREHEATING DEVICE FOR STARTING AN INTERNAL COMBUSTION ENGINE OF THE DIESEL TYPE OR THE LIKE

[75] Inventor: Dominique Arnault, Maintenon Pierres, France

[73] Assignees: Societe Anonyme Automobiles Citroen; Automobiles Peugeot, both of France

[21] Appl. No.: 138,680

[22] Filed: Apr. 9, 1980

[30] Foreign Application Priority Data

Apr. 13, 1979 [FR] France ..... 79 09527

[51] Int. Cl.[3] ..... F02P 19/02; F02N 17/00

[52] U.S. Cl. ..... 123/179 H; 123/145 A

[58] Field of Search ..... 123/179 H, 179 A, 179 B, 123/179 BG, 145 A, 543, 549

[56] References Cited

U.S. PATENT DOCUMENTS

| | | | |
|---|---|---|---|
| 4,088,109 | 5/1978 | Woodruff et al. . | |
| 4,137,885 | 2/1979 | Van Ostrom | 123/179 H |
| 4,177,785 | 12/1979 | Sundeen | 123/179 H |
| 4,207,853 | 6/1980 | Phillips | 123/179 BG |
| 4,258,678 | 3/1981 | Abe | 123/179 H |

FOREIGN PATENT DOCUMENTS

| | | | |
|---|---|---|---|
| 2743059 | 9/1977 | Fed. Rep. of Germany | 123/179 H |
| 2734718 | 2/1979 | Fed. Rep. of Germany | 123/179 H |
| 2393947 | 1/1979 | France . | |
| 2394223 | 1/1979 | France . | |
| 1144574 | 3/1969 | United Kingdom . | |
| 2002449 | 2/1979 | United Kingdom . | |
| 574350 | 9/1977 | U.S.S.R. | 123/179 H |

*Primary Examiner*—P. S. Lall

*Attorney, Agent, or Firm*—Stevens, Davis, Miller & Mosher

[57] ABSTRACT

A pre-heating device, for starting an internal combustion engine, of the Diesel type or the like, comprises a pre-heating plug, mounted in each cylinder, adapted to be supplied by a source of electrical energy to ensure the pre-heating of a combustion chamber, and a rapid pre-heating circuit ensuring the connection of each pre-heating plug to a relatively high electrical voltage. The rapid pre-heating circuit is normally put into operation from the start of pre-heating. A slow pre-heating circuit is also provided to ensure the connection of each pre-heating plug to a lower electrical voltage after a rapid pre-heating period determined by, first time delay means. Said first time delay means is combined with means sensitive to the temperature of the engine arranged so that the rapid pre-heating time depends on the temperature of the engine. Control means are provided to close the supply circuit of the starter automatically on the cut off of the rapid pre-heating circuit and/or to close the slow pre-heating circuit.

23 Claims, 13 Drawing Figures

Ea
17
21
15a
AND
20a
3a
40b
42
40
39
OR
41
37
NAND
34
L
35
36
28
43
38
Timer
33
6
Q1
1a
32
NOR
30
31
27
Monost.
26
12
n
25
11a
B
7
Speed detector
29
H
s
K
Current strength detector
Switch 5
S1, S2
8
Switch 4

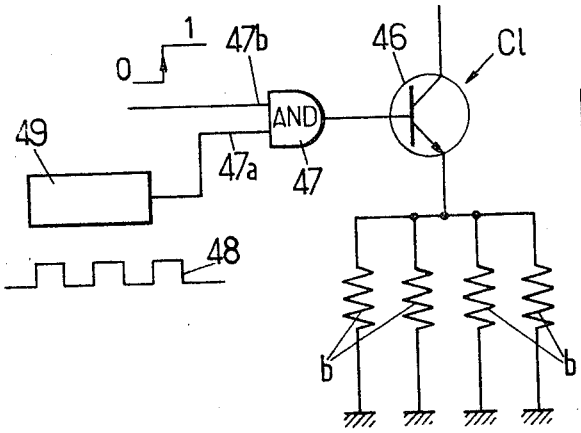
Fig.11.
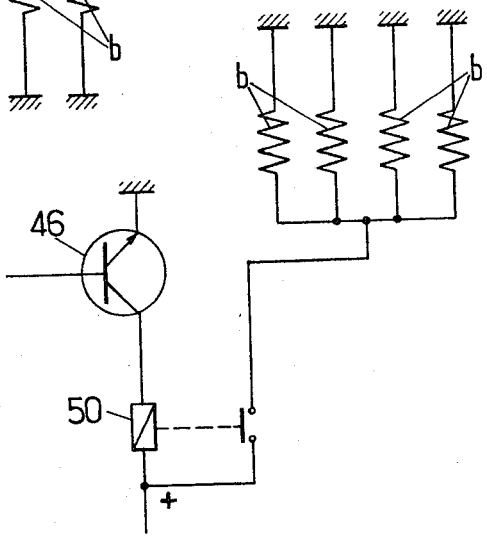
Fig.12.
Fig.13.
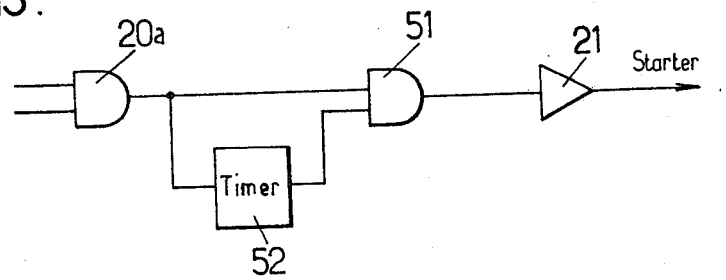
Fig.14.
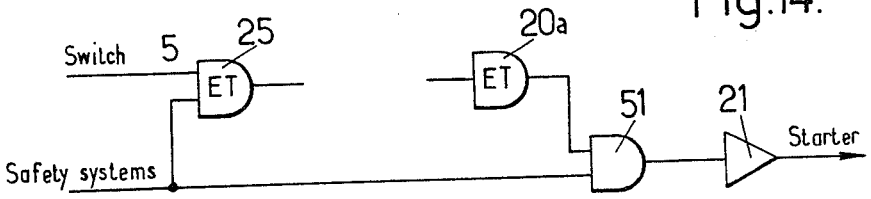

PREHEATING DEVICE FOR STARTING AN INTERNAL COMBUSTION ENGINE OF THE DIESEL TYPE OR THE LIKE

BACKGROUND OF THE INVENTION

1. Field of the Invention

The present invention relates to a pre-heating device for starting an internal combustion engine of the Diesel type or the like. More particularly, the invention relates to a pre-heating device for starting a Diesel type internal combustion engine, comprising a starting plug (or heater plug) mounted in each cylinder adapted to be supplied by a source of electrical energy to ensure the pre-heating of a combustion chamber, a rapid pre-heating circuit ensuring the connection of each pre-heating plug with a relatively high electrical voltage, this rapid pre-heating circuit being normally placed in action from the beginning of the pre-heating, and a slow pre-heating circuit adapted to ensure the connection of each pre-heating plug with a weaker electrical voltage after a rapid pre-heating period determined by a first time delay means.

2. Description of the Prior Art

It is known that the starting of engines of the Diesel or similar type necessitates pre-heating, notably when the engine is cold. This creates a drawback in explosion engines since once the driver has turned the starter key, the driver must generally wait for the appearance of a signal, notably a light signal (indicating that the pre-heating is sufficient), and then actuate the starter for starting the engine.

It is a particular object of the invention to improve this pre-heating device so that it will respond better to the various exigencies of practice notably, this invention will enable a driver to start a motor vehicle of the Diesel or similar type, provided with a pre-heating device of this invention, practically as easy as the starting of a vehicle equipped with a gasoline engine.

GENERAL DESCRIPTION OF THE INVENTION

According to the invention, a pre-heating device for the starting of an internal combustion engine, notably of a Diesel engine of the previously defined type, is characterized by the fact that a first time delay means is combined with means sensitive to the temperature of the engine, arranged so that the rapid pre-heating time depends on the temperature of the engine, and control means are provided to close the supply circuit of the starter automatically on the cut-off of the rapid pre-heating circuit and/or to close the slow pre-heating circuit.

Means sensitive to the speed of the engine are provided to actuate the stopping of the engine and to slow the pre-heating when the internal combustion engine rotates at a sufficient speed.

Preferably, the device comprises means sensitive to a preceding starting order combined with control means so as to prohibit or stop the activation of the rapid pre-heating circuit during a pre-determined time interval which follows a starting attempt or the stopping of the engine.

Thus, it is possible to cause a very rapid rise in temperature of the heater plugs and the combustion chambers while preserving the heater plugs from too severe a heating especially after a first attempt at starting, which is followed almost immediately by a second attempt.

In order to minimize the pre-heating time, the rapid pre-heating circuit ensures the connection of the heater plugs with a temporary electrical over-voltage so that the rise in temperature of the plugs may be rapid.

The first time delay means are advantageously electronic, and comprise, for example, an NTC (negative temperature coefficient) resistor sensitive to the temperature of the engine which is dipped in the cooling water of the engine.

It is advantageous for the means sensitive to a starting attempt to comprise a second time delay means.

In a first embodiment, the second time delay means are triggered when a main switch is opened after the closing and then the opening of the starter switch. Once triggered, the second time delay means delivers a signal inhibiting the pre-heating circuit from being placed into action. This inhibitor lasts for a predetermined duration, which permits slow pre-heating and the starting of the starter.

Means are provided to avoid the triggering of the second time delay means if the main switch has been closed and then opened without the starter switch having been closed and then opened.

It is advantageous for the output of the first time delay means to be connected, on the one hand, to an input of an AND gate whose output controls, possibly through an amplifier and a relay, the activation of the rapid pre-heating, and on the other hand, to the input of an inverter gate whose output is connected to the input of an OR gate. The output of this OR gate is connected to an input of a second AND gate whose output controls, notably through an amplifier and a relay, the placing in action of the slow pre-heating and of the starter. The output of the second time delay means is connected to another input of the OR gate, and, through an inverter gate, to another input of the first AND gate; a second input of the second AND gate is fed by a signal produced on the closing of the starter switch. Preferably, the first and the second AND gates includes a third input connected to an engine speed detector, arranged so as to supply a pre-heating inhibiting signal when the engine rotates at a sufficient speed.

Still within the scope of this first solution, it is possible to provide means enabling the automatic progress of the rapid pre-heating and of the slow pre-heating sequence with the starting of the starter, without it being necessary to keep the starter switch closed, the above-said means automatically triggering the sequence from a simple transient closing of the starter switch.

These means are adapted to memorize the transient closing of the starter switch in order to maintain, at the input of the second AND gate, an order to place in operation the slow pre-heating and starting normally actuated by the signal of the closing of the starter switch.

It is advantageous for these memorizing means to be formed by a flip-flop whose clock input is connected so as to be fed by the transient closing signal of the starter switch, while the input D (data) of this flip-flop is connected to the output of a third AND gate having two inputs fed respectively by the signal at the output of the engine speed detector and by a signal appearing at the closing of the main switch; the output of the flip-flop D is connected to an input of the second AND gate.

According to a second embodiment, the means sensitive to a preceding starting order comprise means sensitive to the temperature of the heater plug combined with a second time delay means, the assembly being arranged so that the rapid pre-heating is stopped if the temperature of the plug reaches or exceeds a value $\theta_0$ during an interval of time, which follows the closing of the starter switch, less than the switchover time of the second time delay means, the slow pre-heating and the starting of the starter then being actuated.

The means sensitive to the temperature of the plug are, advantageously, constituted by a current strength detector which enables the deduction, from the current which passes through the plug supplied by a known electrical voltage source, of the temperature of this plug.

The output of the current strength detector is connected, through a flip-flop RS, to an input of a "NOT AND" gate whose other input is connected to the output of the second time delay means; the output of this "NOT AND" gate is connected to the input of a flip-flop of which one output is connected to a zero reset input of the first time delay means.

The first time delay means are triggered by the closing, even transient, of the starter switch so that the rapid pre-heating commences with this closing.

However, if the current strength detector gives an indication showing that the plug was already warm, the first time delay means are reset to zero and the rapid pre-heating is stopped.

These first time delay means are regulated so as to have a maximum switchover time such that if a pre-heater plug having a temperature equal to $\theta_0$ is subjected, during this maximum switchover time, to the relatively high electrical voltage (rapid pre-heating), it is certain that at the end of this maximum switchover time the temperature reached by the heater plug is not prejudicial to this plug.

The system is arranged so that, in the case of a cold plug, the first time delay means and the rapid pre-heating are started on the closing of the starter switch and that, when the heater plug reaches the temperature $\theta_0$, the first time delay means are re-triggered so that the heater plug is subjected to the rapid pre-heating during a maximum time interval $\Delta tl+\Delta tm$ determined by the time delay, starting from the moment two.

Due to the fact that it is possible to make a current strength $i_0$ absorbed by the plug (at a known predetermined voltage) correspond to the temperature $\theta_0$, the current strength detector is arranged to actuate, on passing through a value $i_0$ corresponding to the temperature $\theta_0$ by the absorbed current strength, a change in state of the output of the associated flip-flop, this change in state actuating the re-triggering of the first time delay means.

It is advantageous to provide a by-passing circuit for the first time delay means comprising, notably, an AND gate.

Means are also provided to actuate the stopping of the rapid pre-heating while allowing the slow pre-heating to start, if the engine is sufficiently hot.

These means comprise a third time delay means adapted to deliver a gating pulse of pre-determined duration, and means for reading the charge of a capacitor through a NTC resistor sensitive to the temperature of the engine; if the voltage at the terminal of the capacitor reaches a pre-determined value in a time less than the gating pulse of the third time delay means (which is manifested by a low value of the NTC resistor), the rapid pre-heating is stopped and the slow pre-heating of the starter is ordered.

The means for reading the charge of the capacitor comprise a comparator adapted to compare the voltage at the terminal of the capacitor with a reference voltage, the output of this comparator being connected to an input of a "NOT AND" gate whose other input is connected to the output of the third time delay means.

The duration of the gating pulse of these three time delay means may be of the order of 0.5 second.

BRIEF DESCRIPTION OF THE DRAWINGS

The invention consists, apart from the above-described features, of certain other features which will be more explicitly considered below with regard to particular embodiments described with reference to the accompanying drawings, but which are in no way limiting.

FIG. 11 is a diagram of an electronic circuit which supplies the heater plugs with electricity under reduced power, thus allowing for slow pre-heating or post-heating.

FIG. 12 is a modification of the diagram of FIG. 11.

FIG. 13 is a diagram of a circuit adapted to limit the supply time of the starter to a pre-determined value.

Finally, FIG. 14 is a diagram of a circuit adapted to permit the starting of the starter only if safety systems are respected.

DESCRIPTION OF PREFERRED EMBODIMENTS

Figure 1:
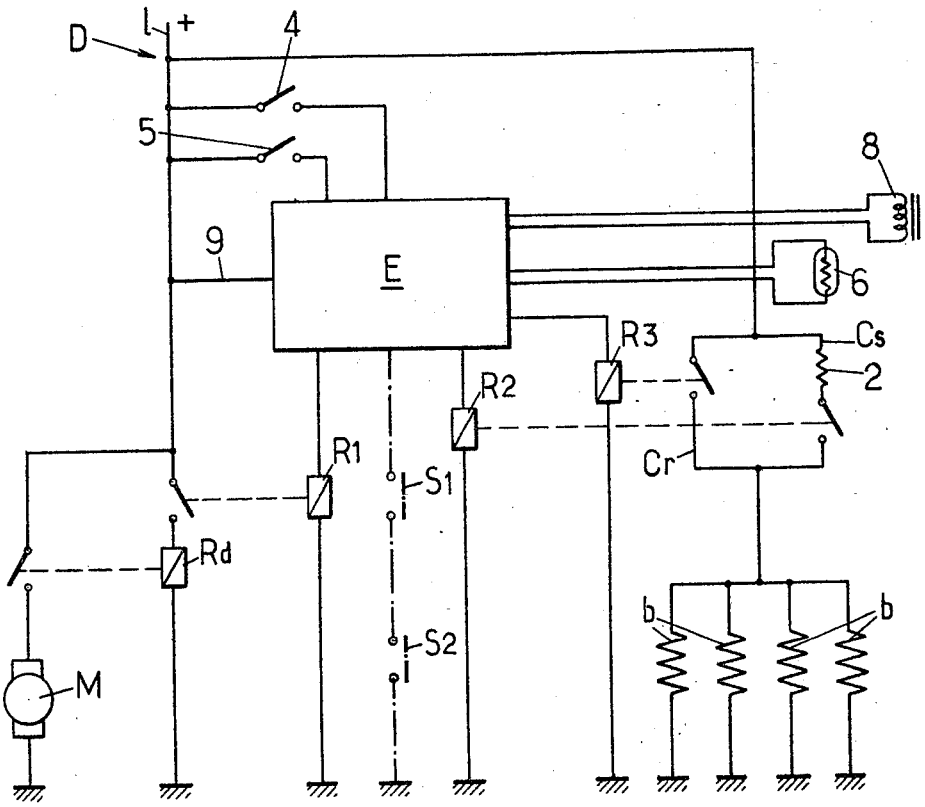
FIG. 1, is a diagram of a pre-heating device, according to a first embodiment discussed previously.

Refering to FIG. 1 of the drawings, a pre-heating device D can be seen for the starting of an internal combustion engine, of the Diesel type (not shown).

This pre-heating device comprises, mounted in each cylinder, a heater plug b shown diagrammatically in the form of an electrical resistor. In the diagram of FIG. 1, four plugs b have been shown; each plug ensures the pre-heating of one combustion chamber associated with the cylinder. The plugs b are adapted to be fed by a source of electrical energy whose positive (+) pole is connected to the conductor 1 and whose negative (−) pole is connected to ground. This energy source will generally constitute a battery in a vehicle equiped with the internal combustion engine.

Figure 2:
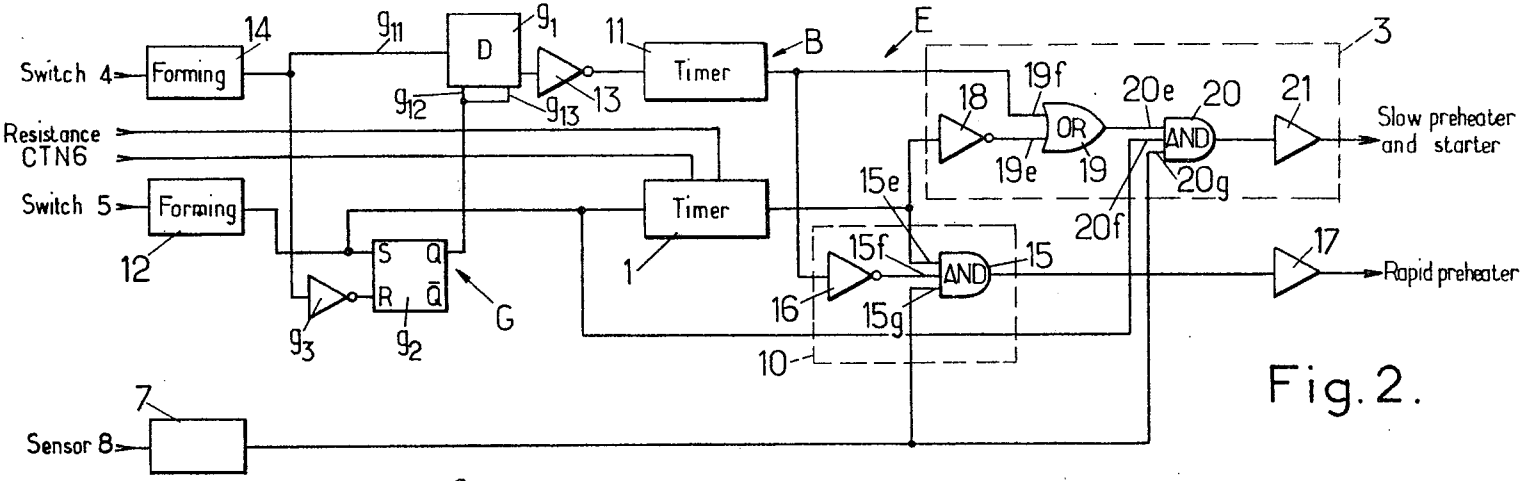
FIG. 2 is a block diagram of the electronic system of a device according to FIG. 1, in the case of assisted starting, that is to say with the maintenance, by the driver, of the closing of the starter switch.
Figure 3:
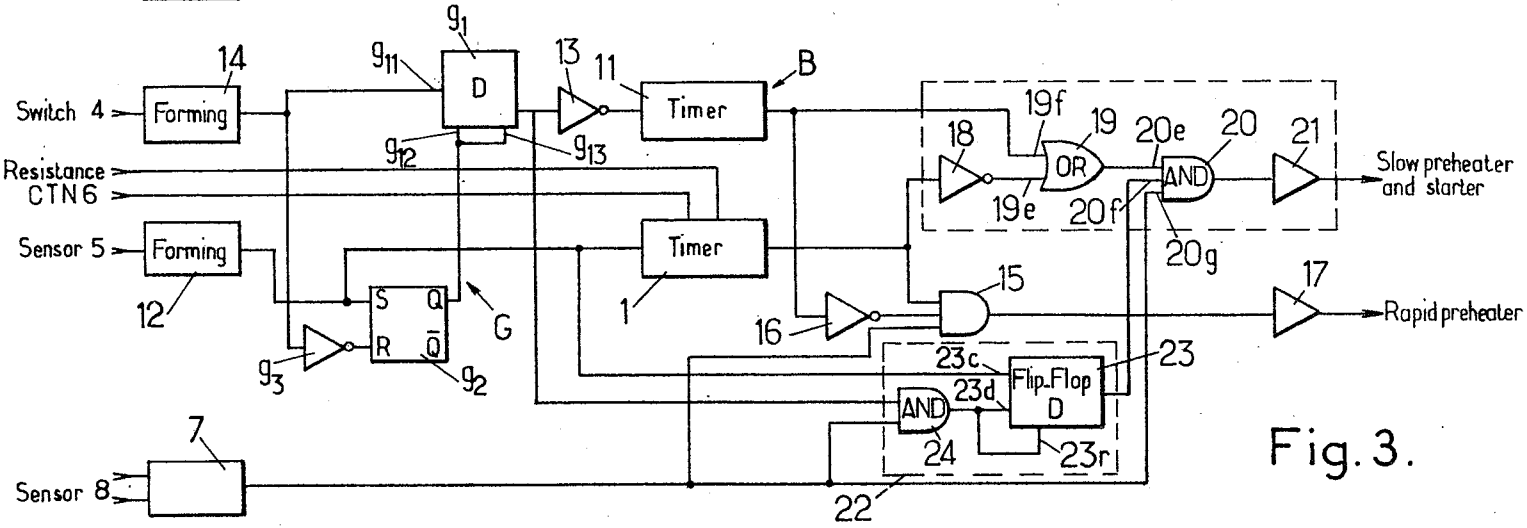
FIG. 3 is a block diagram of the electronic system when the engine is started entirely automatically, that is to say, with transient closing of the starter switch and release of the ignition key.

The device D comprises an electronic control unit E in which first time delay means 1 are provided (FIG. 2 and 3).

As seen in FIG. 1, the device D comprises a rapid pre-heating circuit Cr ensuring the connection of each heating plug b with a relatively high electrical voltage. The closing of this Cr is actuated by a working contact of an electromagnetic relay R3 whose actuating coil is connected between ground and an output of the control unit E. In a modification, the coil could be connected between the +pole and the unit E.

The pre-heating circuit Cr ensures the direct connection of the heater plug b in parallel between the terminals of the electrical energy source and ground. The voltage thus applied to the plugs b is higher than the rated operating voltage of the plugs b; this voltage is such that if the plugs b are maintained for relatively long time, they would be brought to too high a temperature for their endurance. Generally, this voltage is of the order of 12 volts, whereas the plugs b have a rated voltage of the order of 7 volts.

Figure 7:
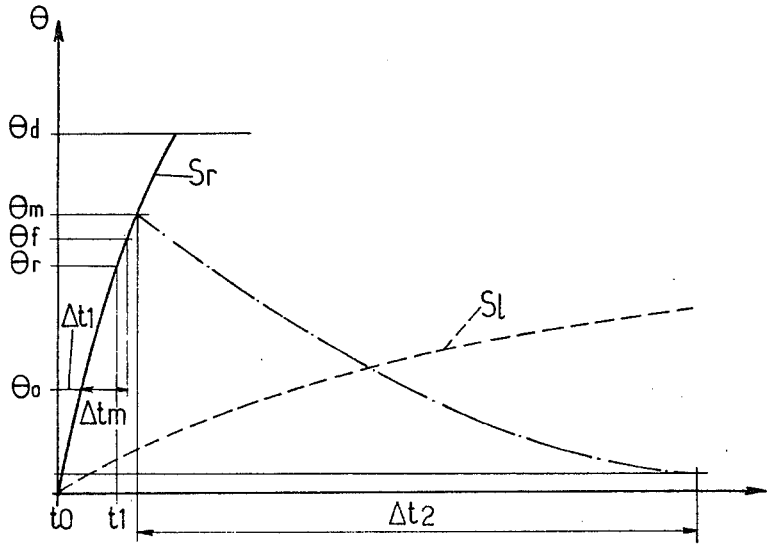
FIG. 7 gives diagrammatic representative curves, of the heating of a plug, whose temperature is plotted as ordinates, as a function of the time t plotted as abscissae, for rapid pre-heating and for slow pre-heating.

Refering to FIG. 7, the heating curve Sr of the plug can be seen as a function of time (the temperature $\theta$ of the plug is plotted in ordinates, while the heating time t is plotted as abscissae) in the case where the rapid pre-heating circuit Cr is in service. The slope of this curve is an increasing function of the voltage applied to the terminals of the plug.

The device D also comprises a slow pre-heating circuit C1 which can be closed by the working contact of an electromagnetic control relay R2 whose actuating winding is connected between ground and an output of the unit E. In a modification, this winding could be connected between the +pole and E. This circuit C1 comprises a voltage-dropping resistor 2 (FIG. 1). The closing of the circuit C1 ensures the supply in parallel, of the plugs b, through this resistor 2; the voltage applied to the plugs is hence lower.

The curve S1, of FIG. 7, which has a distinctly smaller slope than Sr, corresponds to the heating of the plug when only the circuit C1 is in action.

To reduce the pre-heating time to the minimum, the curve Sr (FIG. 7) is given as high a slope as possible.

The first time delay means 1 are arranged to cut off the rapid pre-heating circuit Cr after a time t1 (FIG. 7) determined so that the plugs do not risk damage, that is to say, so that the temperature of the plugs is limited to a value than the destruction temperature $\theta_d$ of the plug.

The device D also includes control means 3 (FIG. 2) provided to ensure, on the opening of the rapid heating circuit Cr, the closing of the slow heating circuit C1 (closing of the working contact of the relay R2 of FIG. 1) and the closing of the supply circuit of the starter M.

This closing of this starter circuit M is ensured through a working contact of a power relay Rd (FIG. 1) whose actuating winding is supplied through a working contact of a realy R1. The winding of R1 is connected between the ground and an output of the control unit E. In a modification, this winding could be connected between the +pole and E.

As seen on FIG. 1, an input of the control unit E is connected to the conductor 1, connected to the +terminal of the battery, through a switch 4 adapted to be closed when the ignition key of the vehicle is placed in its closed position of the main switch. Another input of the unit E is connected to the conductor 1 through a switch 5 adapted to be closed when the ignition key of the vehicle is placed in the "start" position. Two inputs of the unit E are connected to the terminals of an NTC resistor (negative temperature coefficient) 6 sensitive to the temperature of the engine. This resistor 6 may, notably, be dipped into the cooling water circuit of the engine. The two inputs of the unit E connected to this resistor 6 are connected to two inputs of the time delay means 1 as seen in FIG. 2.

Two other inputs of the unit E (connected as seen in FIG. 2 to a detector 7 of the engine speed) are connected to the terminals of a revolution counter 8 sensitive to the rotary speed of the engine.

Another input of the control unit E is permanently connected through a conductor 9 (FIG. 1) to the conductor 1.

The device D comprises means B (FIG. 2), sensitive to a starting attempt, combined with control means 10 (FIG. 2), so as to prohibit or stop the placing in action of the rapid pre-heating circuit Cr during a time interval $\Delta t$ which follows a first starting attempt.

The sensitive means B comprise second time delay means 11.

According to a first embodiment (FIG. 1, 2 and 3) these second time delay means 11 are triggered when, after closing and then opening of the starter switch 5, there is opening of the main switch 4.

Means G (FIGS. 2 and 3) are provided to avoid the triggering of the second time delay means 11 if there has been closing and then opening of the main switch 4 alone, without the starter switch 5 having been closed and then opened.

These second time delay means 11 are adapted to deliver, when they have been triggered, a signal inhibiting the placing in action of the rapid pre-heating circuit, while permitting the slow pre-heating and the starting of the starter.

Now will be described, in more detail, with reference to FIG. 2, the control unit E.

The triggering input of the first time delay means 1 is connected to the output of an anti-rebound circuit or shaping circuit 12. The input of this circuit 12 is connected so as to receive a logic signal "1" on the closing of the starter contact 5.

The triggering input of the second time delay means 11 is connected to the output of an inverter 13. The input of this inverter 13 is connected to the output of a flip-flop D, denoted by the reference g1, belonging to means G.

The data input g11 of this flip-flop is connected to the output of an anti-rebound or shaping circuit 14; the input of this circuit 14 is fed by a triggering signal when the main switch 4 is opened.

The clock input g12 of the flip-flop is connected to a complementary zero reset input g13; the passage from the state "1" to the state "0" of this input g13 hence resets the output of the flip-flop g1 to zero.

The clock input g12 is, also, connected to the output Q of a flip-flop R/S g2 belonging also to the means G. The input S of the clock g2 is connected to the output of the anti-rebound circuit 12. The input R of the flip-flop g2 is connected to the output of an inverter gate g3 whose input is connected to the output of the anti-rebound circuit 14.

The control means 10 comprise an AND gate 15 whose input 15*e* is connected to the output of the time delay means 1; a second input 15*f* of this AND gate is connected to the output of an inverter 16 whose input is connected to the output of the time delay means 11.

A third input 15*g* of the gate is connected to the output of the speed detector 7.

The output of the speed detector 7 is at logic state "1" when the engine is stopped or rotates at a speed less than a certain limit (or threshold).

Upon triggering the time delay means 1 and 11, cause the appearance, of the logic state "1" at their output for a pre-determined time.

The output from the AND gate 15, actuates, through an amplifier 17, the energizing of the control relay R3 of the rapid heating circuit Cr and the closing of the working contact ensuring the supply of the plugs b by this rapid heating circuit.

The control means 3 comprise an inverter circuit 18 whose input is connected to the output of the time delay means 1 and of which the output is connected to an input 19*e* of an OR gate 19. Another input 19*f* of this OR gate is connected to the output of the second time delay means 11.

The output of the OR gate 19 is connected to an input 20*e* of an AND gate 20; a second input 20*f* of this gate is connected to the output of the anti-rebound circuit 12. A third input 20*g* of the gate 20 is connected to the output of the speed detector 7.

The output of the gate 20 actuates, through an amplifier 21, the relay R2 for placing the slow pre-heating circuit Cs in operation, as well as the relay R1 for placing the starter in operation.

The operation of a pre-heating device D equiped with a control system E in accordance with FIG. 2 is as follows.

It relates to operation with assisted starting, i.e., with maintenance of the "contact" key in the "starting" position and hence the maintenance of the switch 5 of FIG. 1, in the closed position.

First order of starting

It is considered that a first order of starting is involved when the period of arrest of the internal combustion engine has been sufficient or when, in the case of a cut off during pre-heating, the contact has been cut for a fairly long time, so that the temperature of the pre-heating drops to a relatively low temperature, close to ambient temperature.

In practice, the duration of the time delay signal 11 is selected to be equal or greater than the interval t2 (FIG. 7) necessary for a pre-heating plug b, starting from its maximum allowable temperature $\theta m$ (FIG. 7), to cool to a temperature close to ambient temperature by cooling in an engine which does not rotate, the two circuits Cr and Cs being opened.

On this first attempt (or first order) of starting, in the above-specified sense, the time delay 11 is at rest and its output is in state "0".

The closing with maintenance of the starting contact 5 produce a signal "1" at the output of the circuit 12; the time delay means 1 are triggered by the rising front of this signal; these time delay means 1 deliver at their output a signal "1" whose duration depends on the value of the thermistor 6 and hence on the temperature of the engine. The duration of the signal is all the less as the engine is at high temperature.

The signal "1" arrives at the input 15*e* of the gate 15.

The signal "0", present at the output of the time delay means 11, is converted, by the inverter 16, into a signal "1" present at the second input 15*f* of the gate 15.

In addition, due to the fact that the internal combustion engine is stopped, the speed detector 7 gives at its output a signal "1", also present at the third input 15*g* of the gate 15.

This AND gate gives, at its output, a "1" signal actuating the closing of the working contact of the relay R3 and the placing in operation of the rapid pre-heating circuit Cr.

The two inputs of the OR gate 19 are fed by a signal "0" so that the output of the gate 19 and hence the output of the AND gate 20 are also at a "0" state, inhibiting the placing in operation of the slow heating circuit Cs and the starting of the starter.

At the end of the time delay, the output of the first means 1 comes back to "0" state, so that the output of the gate 15 passes also to the state "0" and actuates the cut off of the rapid heating circuit Cr. Refering to FIG. 7, it can be seen that the temperature of the plug has reached substantially the value $\theta r$ on the curve Sr.

The output of the means 1 having passed to "0", the inverter 18 gives at its output a signal "1" which feeds the input 19*e* of the OR gate 19. The output of this gate as well as the input 20*e* of the gate 20 pass to the state "1". The second input 20*f* of this gate is also at state "1" due to the fact that a contact 5 is kept closed; the third input 20*g* is also at state "1" since the engine has not started. The output of the gate 20 is at state "1" and actuates the closing of the relay R2 and of the relay R1, which results in the placing in operation of the slow pre-heating circuit Cs and the starting of the starter M.

When the internal combustion engine has started, the output of the speed detector 7 passes to state "0" so that the output of the AND gate 20 also passes to the state "0" which actuates the stopping of the slow pre-heating and of the starter M.

Second order of starting

Second order of starting (or simply 2nd starting), is denoted to be an attempt at starting which is effected shortly after the main switch has been cut; there may be several reasons for this, such as:

(a) after having run the vehicle, the driver cuts off the contact and then starts the engine again shortly thereafter;

(b) the driver has interrupted an attempt at starting and makes a second attempt;

(c) a first attempt at starting is abortive and a second attempt takes place.

Finally, the expression "second order of starting" (or 2nd starting) implies that an attempt at starting is carried out when the pre-heating plugs are already hot; in this second attempt at starting, it is therefore necessary to prevent rapid pre-heating. The ignition key and control circuit system is arranged, conventionally, so that after an abortive attempt at starting, it is necessary, before being able to carry out a further attempt, to open the main switch 4, and then to close it again.

On a second attempt at starting, the contact 4 has hence been previously opened.

The means G come into play to arrange that this opening of the contact 4 only triggers the second time delay means 11 if it has taken place after closing and then opening of the starter switch 5.

It is recalled that a flip-flop D causes the passage at its output, of the state which occurs at its "data" input, when the clock input is at state "1".

The flip-flop g1 serves to only pass a triggering signal of the second time delay means 11, on the opening of the contact 4, if a starting attempt has taken place, i.e., if the switch 5 has been closed and then opened.

In fact, if the contact 4 is closed and then opened, without there having been closure and then opening of the contact 5 of the starter, the output Q of the flip-flop g2 remains at "0". The clock input g12 of the flip-flop g1 is at "0" as well as the complemented reset to 0 input g13, so that the output of the flip-flop g1 remains at "0".

If, after closing the contact 4, there is a starting attempt by closing the contact 5, the input S of the flip-flop (R/S) g2 is fed by a signal which causes passage to the state "1" of the output Q, and hence the clock input g12 of the flip-flop D) g1. The state "1" which occurs at the input g11 is then transmitted, through the flip-flop D, to its output.

On opening the switch 4, the inverter gate g3 transmits to the input R of the flip-flop g2 a signal which causes the output Q to pass from state "1" to state "0".

The inputs g12 (clock) and g13 of the flip-flop g1 are brought to the state "0", and the output of the flip-flop g1 is reset to "0".

The inverter gate 13 converts the dropping front on passage from "1" to "0" of the output of g1 at the rising front from "0" to "1" at the input of the second time delay means 11 which are thus triggered.

If the time interval between the end of the first attempt and the starting of the second attempt at starting is less than the time of change-over of the second time delay means 11, on the second attempt at starting, on the closing of the starting switch 5, the time delay 1 is triggered, although the second time delay 11 is again triggered.

As a result, the input 15*f* of the gate 15 is at state "0" ("1" at the output of 11, hence "0" is at the output of 16); although the input 15*e* is brought to "1", the output of the gate 15 remains at "0" and the rapid pre-heating does not take place.

On the other hand, the input 19*f* of the OR gate 19 is in the state "1", the output of the gate 19 is also at the state "1". The three inputs of the gate 20 will be at state "1".

The output of the gate 20 is hence at state "1" and actuates the slow pre-heating and the placing in operation of the starter.

Referring to FIG. 7, it is seen that the temperature of the plug, even if it had been close to $\theta r$ at the start of this second attempt at starting, does not reach a prejudicial value since the heating is effected by slow pre-heating, with a sufficiently small slope.

The control unit E whose diagram is given in FIG. 3 enables an automatic starting sequence so that it is not necessary to keep the starting switch 5 closed; it suffices to carry out a transient closing of the switch 5 and to release the starting key, to trigger the automatic starting sequence.

The majority of the elements of the diagram of FIG. 3 are identical with those already described with reference to FIG. 2, and are denoted by the same reference numerals.

However, the control unit of FIG. 3 includes means 22 adapted to memorize the transient closing of the starter switch 5 in order to maintain, at the input 20*f* of the AND gate, a state "1" corresponding (when the two other inputs 20*e* and 20*g* are at state "1") to an order to place in operation the slow pre-heating and starting.

The memorizing means 22 comprise a "flip-flop D" 23 whose clock input 23*c* is connected to the output of the anti-rebound circuit 12. The "data" input 23*d* of this flip-flop is connected to the output of an AND gate 24. This input 23*d* is, in addition, connected to the input 23*r* of the "0" reset of the flip-flop.

It will be recalled that the "0" reset of the flip-flop "D" is obtained either by setting the input 23*r* at level "0", or by sending a pulse to the clock input 23*c* when the data input 23*d* is at level "0".

The connecting of the flip-flop D is such that its output is reset to "0" each time that the switch 4 is opened (FIG. 1).

The AND gate 24 includes two inputs connected respectively to the output of the flip-flop g1 and to the output of the speed detector 7.

Since the starting sequence is entirely automatic, in the case of a false manoeuvre, the reaction time of the driver to open the switch will be longer due to the fact that he will have released the switch key.

To avoid accidents, the starting device is completed by a safety device shown in mixed lines in FIG. 1 comprising two safety switches S1, S2, connected in series between ground and an input of the control device E. These safety switches are adapted to be closed respectively when the gear-box is in neutral and when the hood is locked. If at least one of these switches is opened, the starting of the starter is inhibited. This inhibition can be effected, for example, by providing an additional input (not shown) at the AND gate 20 of FIG. 3 and by connecting to this input a lead to which a signal "1" is applied when the two switches S1, S2 are closed and a signal "0" when at least one of these switches is opened.

The operation of the starting device equipped with the control unit whose diagram is given in FIG. 3 is identical with that described with reference to FIG. 2, the only difference being that in the case of the diagram of FIG. 3, it suffices to effect a transient closing of the starting switch 5 and then to release the key. The starting sequence is then automatic.

The closing of the main switch 4 takes place for an angular position of the switch key situated before the closing of the starter switch 5. The closing of the switch 4 causes the output of the anti-rebound 14 to pass to state "1". The subsequent transient closing of the starter switch 5 causes the output of the anti-rebound 12 to pass to state "1" during a certain interval of time. The output Q of the flip-flop g2, as previously explained, passes to state "1"; the clock input g13 of the flip-flop D being fed with a signal "1", the state "1" of the input g11 passes to the output of the flip-flop D and hence to an input of the "AND" gate 24 and to the input of the inverter gate 13.

The other input of the "AND" gate 24 connected to the feed detector 7 is also at state "1", the engine being assumed stopped. The output of the AND gate 24 is hence at state "1".

The state "1" present at the output of the circuit 12 is also sent to the clock input 23*c* of the flip-flop 23, which causes the state "1" occuring at the input 23*d* (connected to the output of the AND gate 24) to transmit to the output of the flip-flop 23 and hence to the input 20*f* of the gate 20.

In addition, the passage to state "1" of the output of circuit 12 triggers the first time delay means 1.

Where a first starting in the previously defined sense is concerned, the output of the second time delay means 11 is at "0" so that the output of the inverter gate 16 is at state "1"; the two inputs of the AND gate 15 are at state "1" so that rapid pre-heating is ordered. The two inputs of the OR gate 19 are at state "0" so that the slow pre-heating relay R2 and the starting relay Rd are not energized.

When the output of the first time delay means 1 comes back to state "0", the rapid pre-heating is stopped and the starting of the starter and the ordering of the slow pre-heating are ensured.

On the hypothesis that the driver would have to carry out a second starting attempt (second order of starting in the previously defined sense), the operation would be as follows.

First, and conventionally, to carry out a second such attempt, the driver must bring back the switch key to the position where the main switch 4 is opened.

The means G take part as described previously.

When the output of the circuit 14 passes to the state "0", it is the same for the output of the flip-flop g1, the output of the AND gate 24 and the input 23*d*, as well as the input 23*r*. The fact of bringing this input 23*r* to the low level causes the resetting to "0" of the output of the flip-flop 23.

On the opening of the main switch (after opening and cutting of the contact 5 of the starter), the output of the inverter gate 13 has passed to state "1" which has triggered the second time delay means 11 whose output passes to state "1" during a pre-determined time. The output of the inverter gate 16 passes to state "0" so that the output of the AND gate 15 remains at state "0" during the whole time of switching over of the second time delay means 11.

On closing, for this second attempt, of the main switch 4 and then the transient closing of the starter contact 5, the output of the flip-flop 23 passes to state "1" and remains at this state "1" as long as the main switch is not opened.

The output of the time delay 11 being at state "1", the input 20*e* of the gate 20 is also at state "1"; the input 20*g* is at state "1" due to the fact that the engine is stopped.

The output of the AND gate 20 is at state "1" and the starting of the starter with slow pre-heating is immediately actuated on this second attempt.

Figure 4:
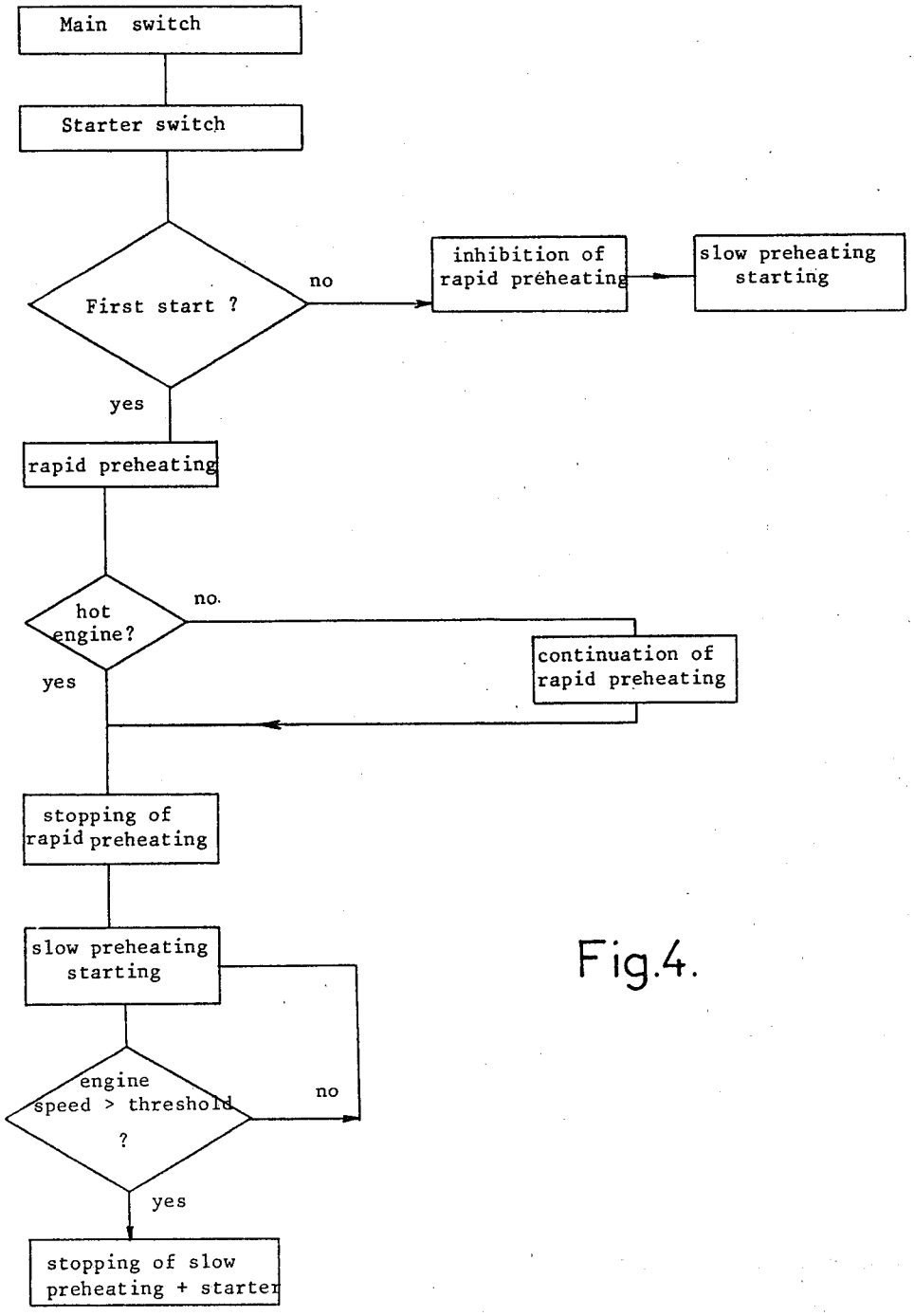
FIG. 4 is a diagram summarizing the operation of the starting device according to the first solution.

The diagram of FIG. 4 summarizes, briefly, the operation of the pre-heating device of FIGS. 1 to 3. It seems unnecessary to dwell further on this diagram which corresponds entirely with the previously provided explanations. It is to be noted that this diagram of FIG. 4, like that of FIG. 8 moreover, is to be considered as forming part of the description.

A second solution, which will now be described with reference to FIGS. 5 and the following ones, provides means H sensitive to the strength of the current which passes through the pre-heating plugs and hence, as explained below, to the temperature of these plugs; these means H are combined with the second time delay means 11*a* so as to form the means B sensitive to a first order of starting.

The elements and circuits of the second solution which are identical or which play similar roles to elements and to circuits already described with reference to the first solution are denoted by the same reference figures or letters, if necessary followed by the letter a.

Figure 5:
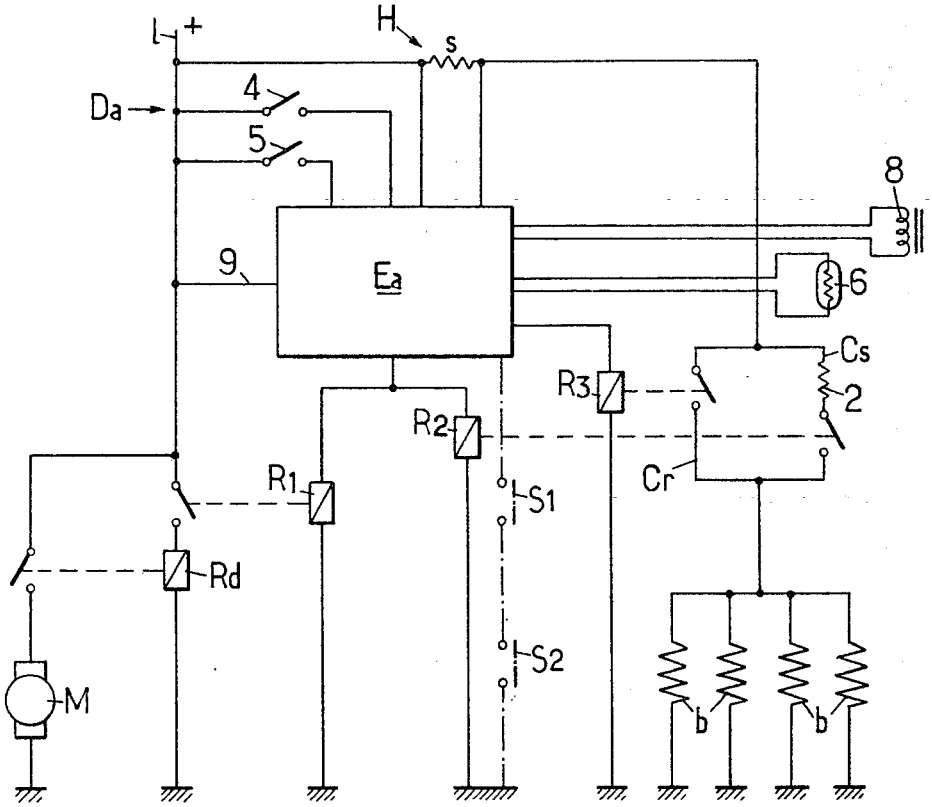
FIG. 5 is a general diagram of a pre-heating device, according to the invention, in accordance with the previously evoked second solution.

The diagram of FIG. 5 of the pre-heating device Da, in accordance with this second solution, differs from the device D shown in FIG. 1 essentially by its control unit Ea and by the presence of a shunt s connected to the electrical supply lead of the plugs, the two shunt terminals s being connected to two inputs of the control unit Ea.

This shunt s belongs to the means H sensitive to the temperature of the plug.

This shunt enables the strength of the current which supplies the plugs b to be measured. Due to the fact that these plugs are supplied with a well-determined voltage, corresponding to that of the battery of the vehicle, it is known that to a given current strength corresponds a predetermined resistance of each plug. The correspondence between the resistance of a plug and its temperature being known with good precision, it is possible to consider that the information on the strength of the current supply to the plugs is equivalent to information on the temperature of these plugs.

Figure 6:
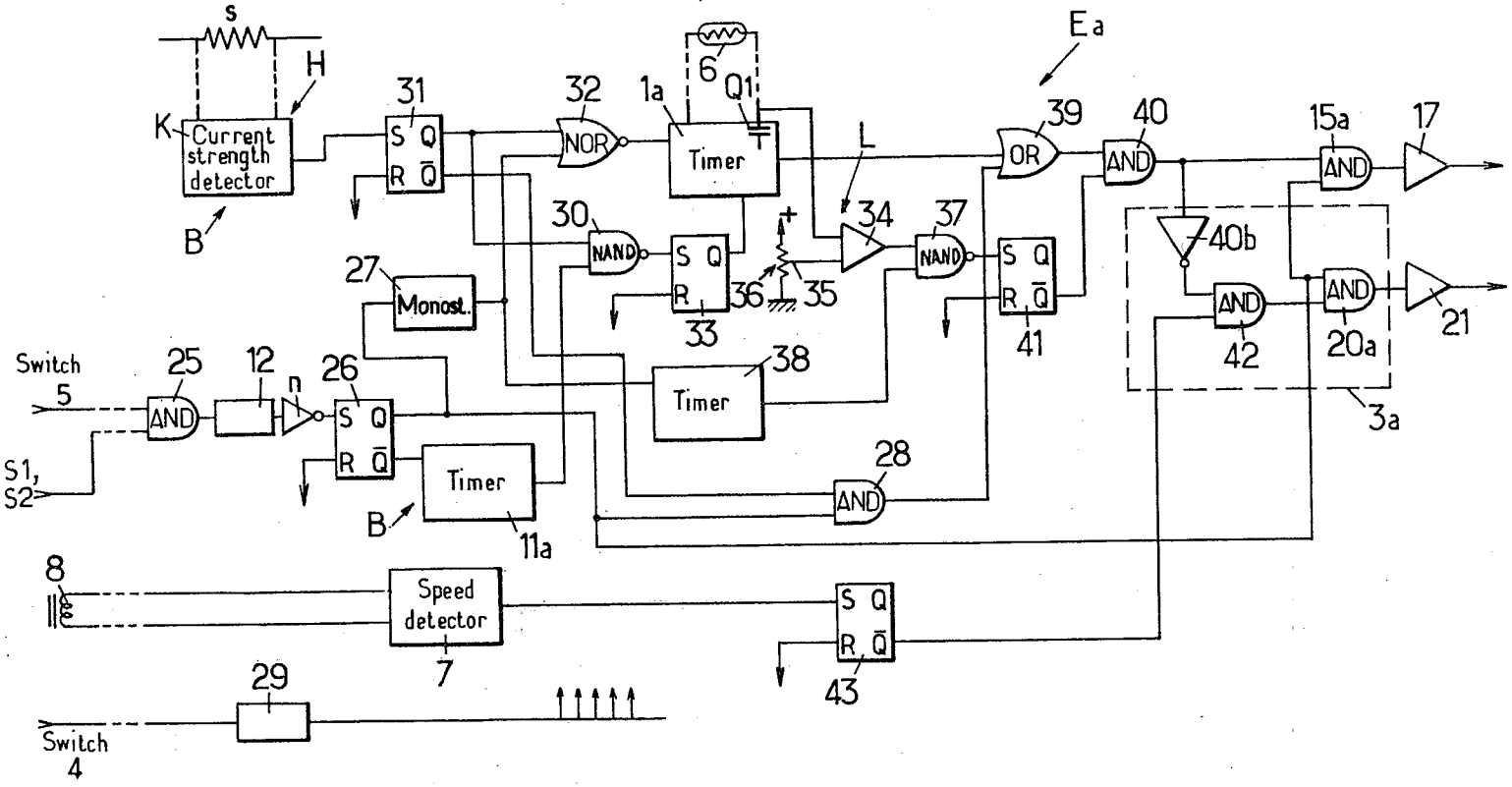
FIG. 6 is a block diagram of the electronic system of the device of FIG. 5.

The detailed description of the control unit Ea is given with reference to FIG. 6.

The input of the anti-rebound circuit 12 is connected to the output of an AND gate 25. One input of this gate 25 is connected to the starter switch 5 so as to be brought to state "1" when this switch 5 is closed; another input of the gate 25 is connected to the safety switch S1, S2 so that this input is brought to state "1" when these contacts are closed, i.e., when the gear lever is in neutral position and when the hood is closed; if necessary, other safety devices could be provided and connected to an input of the AND gate 25.

The output of the anti-rebound circuit 12 is connected to the input S of a flip-flop 26 of the RS type (set—reset; triggering-reset to zero), through an inverter gate n.

The output Q of this flip-flop 26 is connected, to the input of a monostable flip-flop 27, to an input of an AND gate 28 and, lastly, to an input of another AND gate 20*a*.

The complemented output $\overline{Q}$ of the flip-flop 26 is connected to the input of the second time delay means 11*a*.

It should be noted that the flip-flop RS 26, as well as all the flip-flops RS which will be considered below, are arranged so that their output Q changes its state when the input S is fed with a dropping front, that is to say, on the passage from state "1" to state "0" of the input S.

The monostable flip-flop is arranged so as to deliver at its output a gating pulse (passage of its output from state "0" to state "1") of very short duration, for example, of the order of some milliseconds, when the output Q of the flip-flop 26 passes from state "0" to state "1".

The unit is arranged so that on opening the general switch 4, the pulses sent by the circuit 29 to all the inputs R of the flip-flops RS, reset the outputs Q to "0".

The time delay 11*a* is triggered on the passage of the output $\overline{Q}$ of the flip-flop 26 from state "1" to state "0". The output of the time delay 11*a* is connected to one input of a NOT AND gate 30.

A second input of this gate 30 is connected to the output Q of a flip-flop RS 31. The input S of this flip-flop 31 is connected to the output of a current strength detector K, connected to the terminals of the shunt s. This current strength detector K is arranged so as to give at its output, and hence at the input S of the flip-flop 31, a state "1" when the strength of the electrical current passing through the shunt s is greater than a value $i_0$. When the strength becomes equal to or less than this limit, the output of the detector K passes to the state "0".

The output Q is also connected to one input of a NOT OR gate 32; another input of this gate 32 is connected to the output of the monostable flip-flop 27. The output of this gate 32 is connected to the triggering input of the first time delay means 1*a*.

These time delay means 1*a* are adapted to be triggered by a dropping front, i.e., on passage from state "1" to state "0" at their input. Their triggering results in the presence of the state "1" at their output for a predetermined time. The presence of the thermistor 6 connected to this time delay 1*a* as explained with reference to FIGS. 2 and 3 will again be noted.

The complemented output $\overline{Q}$ of the flip-flop 31 is connected to a second input of the gate 28.

The output of the gate 30 is connected to the input S of a flip-flop RS 33 whose output Q is connected to one reset to "0" input of the time delay means 1*a;* the passage of the output Q of the flip-flop 33 from state "1" to state "0" resets to "0" the output of the time delay 1*a*.

The first time delay means 1*a* include a capacitor Q1 connected so that when the time delay 1*a* is triggered, this capacitor Q1 is traversed by a charging current passing through the thermistor 6. The charge of this capacitor, and hence the rise in electrical voltage at the terminals of this capacitor, will be faster as the value of the thermistor 6 decreases. Due to the fact that this thermistor has a negative temperature coefficient, the rise in electrical voltage will be faster when the engine is hotter.

The maximum duration of switch-over Δtm of the time delay device 1*a* is such that if a pre-heating plug having a temperature equal to $\theta_o$ ($\theta_o$ corresponds to the current strength $i_o$ passing through the shunt s) is subjected during this maximum duration of switch-over Δtm to the high electrical voltage (rapid pre-heating), it is certain that at the end of this duration of switch-over, the temperature $\theta_f$ reached by the pre-heating plug is not prejudicial to this plug. In other words, it is certain that $\theta_f$ is less than or equal to $\theta_m$ (FIG. 7).

Read-out means L of the charge of the capacitor Q1 are provided. These means L comprise a comparator 31 of which one input (not inverting) is connected to a terminal of the capacitor Q and of which the other input (inverting) is connected to the cursor 35 of a potentiometer 36 so as to define an electrical reference voltage adjustable by the position of the cursor. The comparator 34 is adapted to compare the voltage at the terminals of the capacitor Q1 with this reference voltage.

When the voltage at the terminals of the capacitor Q1 is less than the reference voltage, the output of the comparator 34 is at state "0"; when the voltage at the terminals of the capacitor Q1 becomes equal to or greater than the reference voltage, the output of the comparator 34 passes to state 1. This output of the comparator 34 is connected to one input of a NOT AND gate 37. Another input of this gate 37 is connected to the three time delay means output 38. The triggering input of these time delay means 38 is connected to the output of the monostable flip-flop 27. The triggering of these time delay means 38, i.e., the passage from state "0" to state "1" of the output of this time delay 38 is actuated by the passage from state "0" to state "1" of the output of the monostable flip-flop 27.

The duration of triggering of the time delay means 38 is advantageously of the order of 0.5 second.

The output of the time delay means 1*a* is connected to one input of an OR gate 39 of which another input is connected to the output of the gate 28.

The output of the gate 39 is connected to an input of an AND gate 40. Another input of this gate 40 is connected to the complemented output $\overline{Q}$ of the flip-flop RS 41. The input S of this flip-flop 41 is connected to the output of the gate 37.

The output of the gate 40 is connected to an input of the AND gate 15*a*. The output of the gate 40 is also connected to the input of an inverter circuit 40*b;* the output of the circuit 40*b* is connected to an input of an AND gate 42.

Another input of this gate 42 is connected to the complemented output $\overline{Q}$ of a flip-flop RS 43. The input S of the flip-flop 43 is connected to the output of the speed detector 7. It is recalled that the output of the detector 7 is at state "1" when the engine is stopped or when the speed is less than a pre-determined threshold.

The "0" reset input R of the flip-flop 43, like all the other "0" reset inputs R of the flip-flops 26, 31, 33 and 41, is connected to the output of the circuit 29.

The output of the AND gate 42 is connected to one input of the AND gate 20*a;* the other input of this gate 20*a* is connected both to the output Q of the flip-flop 26 and to an input of the gate 15*a* different from that to which the output of the gate 40 is connected.

The outputs of the gates 15*a* and 20*a* are connected, as in the case of FIGS. 2 and 3, to the relays R3 and R2, RD, respectively through amplifiers 17, 21.

The operation of the starting device Da of FIGS. 5 and 6 is as follows.

Case of a first starting

The engine is cold.

The transient closing of the starter switch 5 sends a pulse "1" to an input of the gate 25; if the safety systems are respected (gear-box in neutral, hood closed), the other input of this gate 25 is also at state "1" and the output of this gate passes also to state "1".

The anti-rebound circuit 12 supplies at its output a square pulse; the rising front of this pulse is converted, by the inverter n, into a dropping front, which in being applied to the input S of the flip-flop 26 causes the output Q to pass to state "1" and the complemented output $\overline{Q}$ to state "0".

It is to be noted that if the driver keeps the starter switch 5 closed, the signal at the output of the inverter gate n remains formed through dropping front produced at the closing of the contact 5; this dropping front is again available for the control of the flip-flop 26.

The passage of the output Q of this flip-flop 26 to state "1" triggers the monostable flip-flop 27 which delivers, at its output, a positive square pulse (passage from state "0" to state "1"); the output of the NOT OR gate 32 delivers a negative square pulse (passage from state "1" to state "0" with return to state "1") at the input of the time delay device 1*a*. The dropping front of this negative square pulse triggers the time delay 1*a*. The output of this time delay passes to state "1" and this state is transmitted through the OR gate 29 and through the AND gate 40 and 15*a* (for the reasons explained below) to the amplifier 17 which actuates the relays R3 so that the rapid pre-heating circuit Cr is closed (FIG. 5).

The pre-heating plugs are then fed with electrical current and a current strength passes through the shunt s. The engine being assumed cold, the pre-heating plugs are cold and their resistance is relativey low; the current strength which passes through the shunt s is greater than $i_0$ and the output of the detector 32 is at state "1". The output Q of the flip-flip 31 remains at state "0". The other input of the gate 30 is at the state "1" during the time of the switch-over of the time delay 11*a* which has been triggered, on the transient closing of the switch 5, by the passage of the complemented output $\overline{Q}$, of the flip-flop 26, from state "1" to state "0".

As long as the output Q of the flip-flop 31 is at state "0", the output of the gate 30 remains at state "1" and the output Q of the flip-flop 33 remains at state "0".

The switch-over of the monostable 27 has also triggered the third time delay means 38 which deliver at their output a signal at state "1" of a pre-determined duration.

The engine being assumed cold, the resistance of the NTC thermistor 6 is relatively high so that the voltage at the terminals of the capacitor Q1 increases relatively slowly. This voltage has not reached the reference value before the end of the square pulse delivered by the time delay 38. As a result, the output of the comparator 34 remains at state "0" while the output of the time delay 38 is at state "1".

The output of the NOT AND gate 37 of which one input is at state "0" and the other at state "1", occurs at state "1". The input S of the flip-flop 41 is at state "1"; the output Q is at state "0" while the complemented output $\overline{Q}$ is at state "1".

The second input of the gate 40 connected to this output $\overline{Q}$ is hence at state "1", which explains why the state "1" present at the output of the time delay 1*a* is transmitted to the input of the gate 15*a*.

The second input of this gate 15*a* is at state "1" which is that of the output Q of the flip-flop 26. This explains why the state "1" is also transmitted to the amplifier 17 which actuates the closing of the rapid heating circuit Cr.

The inverter circuit 40*b* applies the state "0" to one of the two inputs of the gate 42 so that the output of this gate 42 and the corresponding input of the gate 20*a* are at state "0"; it is the same for the output of the gate 20*a* which prohibits the placing in operation of slow pre-heating and of starting.

The maximum duration of switch-over of the time delay 1*a* is relatively brief and ends, as explained previously with reference to FIG. 7.

It is hence possible that the output of the time delay 1*a* may come back to state "0" before the plug has reached the temperature $\theta_0$, corresponding to the current strength $i_0$ passing through the shunt s.

The by-pass circuit established by the AND gate 28 enables the maintenance of rapid pre-heating.

In fact, the input of the gate 28 connected to the complemented output $\overline{Q}$ of the flip-flop 31 is at state "1" while the other input of this gate 28 connected to the output Q of the flip-flop 26 is also at state "1". The output of the gate 28 connected to one input of the OR gate 39 is hence at state "1" and maintains the rapid pre-heating order.

When the pre-heating plugs reach the temperature $\theta_0$, their resistance (which increases with increase in temperature) is such that the current strength which passes through the plugs is equal to $i_0$, this strength having a tendancy to diminish.

Passage through this value $i_0$, in the direction of decreasing value, causes the switch-over of the current strength detector K whose output passes to state "0".

The dropping front, applied to the input S of the flip-flop 31, causes the output Q of this flip-flop to pass to state "1" and the complemented output $\overline{Q}$ to state "0".

The output of the monostable 27 has come back to state "0" well before the change in state of the output Q of the flip-flop 31. The two outputs of the NOT OR gate 32 hence are at state "0" and the output is at state "0".

The change in state of the output Q of the flip-flop 31 causes the passage from state "1" to state "0" of the output of the gate 32, which causes a re-triggering of the time delay 1*a*.

Hence from this re-triggering, the time delay 1*a* will ensure the maintenance of rapid pre-heating during a time $\Delta to \leqq \Delta tm$.

It is thus seen, with reference to FIG. 7, that there is applied to the re-heating plug, from the moment when it passes through the temperature $\theta_0$, a rapid pre-heating which it is certain will not heat the plug beyond the temperature $\theta f$.

When the output of the time delay 1*a*, after this re-triggering, comes back to state "0", the rapid pre-heating ceases. In fact, the output of the gate 28, since the complemented input $\overline{Q}$ of the flip-flop 31 has passed to state "0", is also at state "0". On the return to state "0" of the output of the time delay 1*a*, the two inputs of the OR gate 39 are at "0" which results in the state "0" at the output of the gate 15*a* and the end of rapid pre-heating.

On the other hand, the inverter circuit 40*b* sets the input associated with the gate 42 to state "1", whose output passes also to state "1"; it is the same for the output of the gate 28, which ensures that the placing of the slow pre-heating and of the starter is in action.

The duration of switch-over $\Delta to$ of the time delay 1*a* depends on the temperature of the engine sensed by the NTC thermistor 6.

The engine is hot (first starting).

This is the case where the pre-heating plugs are at a temperature distinctly beow $\theta_0$, while the engine is hot.

The majority of the explanations given previously still apply.

However, due to the fact that the engine is hot, the value of the resistance of the NTC thermistor 6 is low. If the temperature of the engine exceeds a pre-determined limit which notably depends on the value of the thermistor 6, of the capacitor Q1 and of the adjustment of the comparator 34, the voltage at the terminals of the capacitor Q1 will exceed the reference voltage, set by the cursor 35, before the output of the time delay 38 comes back to "0".

On this passage to excess, the output of the comparator 34 passes to state "1" so that the two inputs of the NOT AND gate 37 are at state "1"; the output of this gate 37 passes from state "1" to state "0". The dropping front causes the complemented output $\overline{Q}$ of the flip-flop 41 to pass from state "1" to state "0". The output of the gate 40 passes to state "0" so that the rapid pre-heating is stopped, while the placing of the slow pre-heating and of the starter in action is ordered.

Case of a hot pre-heating plug.

This is the case of the second order of starting mentioned previously; it relates to an order for staring given shortly after the engine has been cut off after having been rotated (engine still hot) or of a starting order which follows, shortly after, a preceding starting order.

The time delay 1*a* will be triggered on the closing of the switch 5 of the starter as previously explained.

However, if the temperature of the plugs is close to $\theta_0$ or higher than $\theta_0$, the current strength which passes through the shunt s, will become or is less than $i_0$. The output of the current strength detector K will pass from state "1" to state "0" which causes the output Q of the flip-flop 31 to pass to state "1".

The time delay means 11*a* are regulated so that when the plug, on starting, has a temperature slightly less than (or a fortiori higher than) $\theta_0$, the passage of the output Q of the flip-flop 31 to state "1" occurs before the output of the time delay 11*a* has come back to state "0". The two inputs of the NOT AND gate 30 being at state "1", the output of this gate 30 passes from state "1" to state "0" which causes the state of the output Q of the flip-flop 33 to change in state, this output Q passing from state "0" to state "1".

This change to state "1" of the output Q of the flip-flop 33 resets to "0" the output of the time delay 1*a*. In addition, the complemented output $\overline{Q}$ of the flip-flop 31 is at state "0" while the output of the gate 28 is also at state "0". The two inputs of the OR gate 39 are at state "0", and the rapid pre-heating is stopped.

The placing in operation of the slow pre-heating and of the starter are actuated through the gates 42 and 20*a*.

It is to be noted that, in all cases, when the internal combustion engine reaches a sufficient speed causing the output of the speed detector 7 to pass from state "1" to state "0", the output $\overline{Q}$ of the flip-flop 43 passes from state "1" to state "0"; the output of the gate 42 passes also to state "0", which actuates the stopping of the slow pre-heating and the current supply to the starter.

Figure 8:
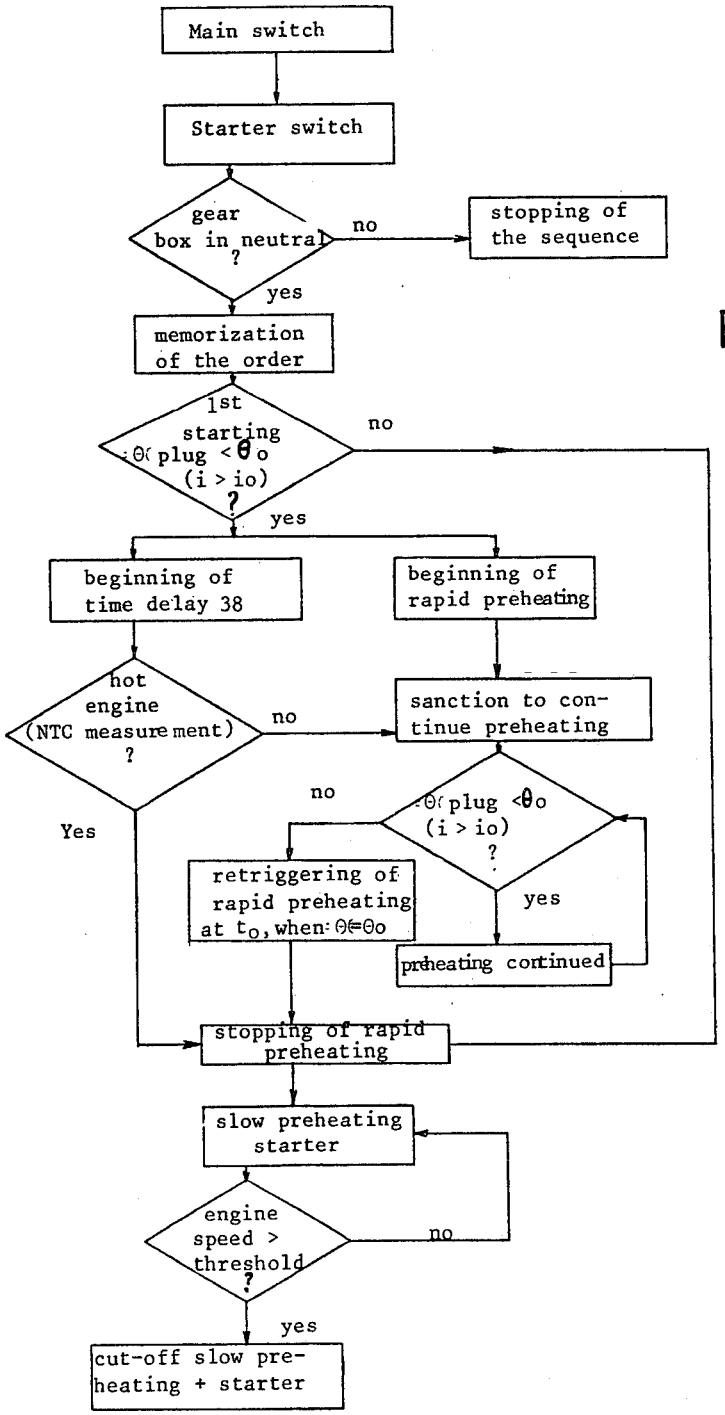
FIG. 8 is a diagram summarizing the operation of the device of FIGS. 5 and 6.

The diagram of FIG. 8 summarizes the explanations of operation given previously.

Figure 9:
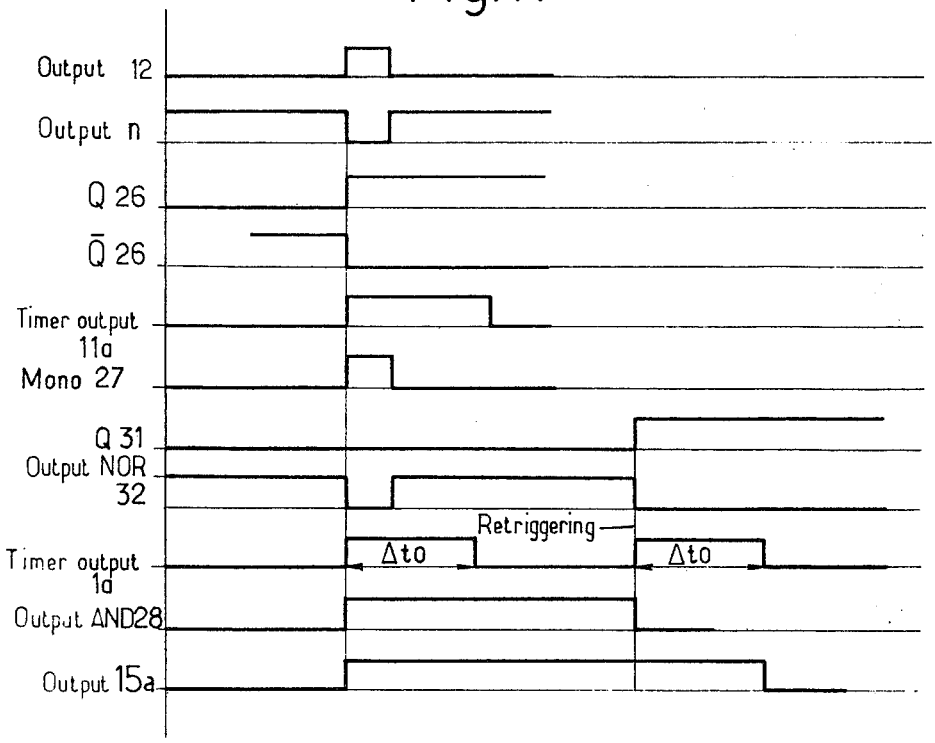
FIG. 9 is a diagram showing the logic states at different points of the electronic circuit of the diagram of FIG. 6.

FIG. 9 is a diagram summarizing the states at different points of the circuit of FIG. 6.

The upper line of FIG. 9 represents the output of the anti-rebound circuit 12.

The second line represents the output of the inverter n.

The third line represents the output Q of the flip-flop 26.

The fourth line shows the output Q of the flip-flop 26.

The fifth line represents the output of the time delay 11*a*.

The sixth line represents the output of the monostable flip-flop 27.

The seventh line represents the states at the output Q of the flip-flop 31.

The eighth line represents the states at the output of the NOT OR gate 32.

The ninth line represents the states at the output of the time delay 1*a*.

The tenth line represents the states at the output of the AND gate 28.

The eleventh line represents the duration of closing of the rapid pre-heating circuit.

The re-triggering of the time delay 1*a*, when the current strength passing through the shunt passes through the value $i_0$ appears clearly at the tenth line of the diagram of FIG. 9.

Since the rapid plugs b generally have a low thermal inertia, it is advantageous to keep post-heating after the starting of the internal combustion engine, so as to avoid stalling.

Figure 10:
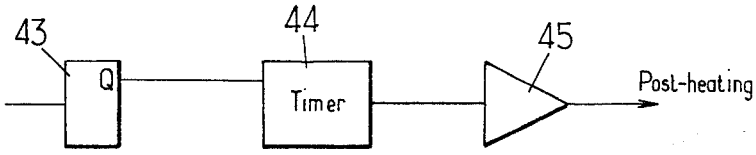
FIG. 10 is a diagram of an additional electronic circuit enabling post-heating to be maintained after starting.

FIG. 10 shows a circuit enabling such post-heating to be accomplished.

The output Q of the flip-flop 43 of FIG. 6 is connected to the input of the time delay 44 which is triggered by the passage from state "0" to state "1" of the output Q. The output of the time delay 44 actuates, through an amplifier 45, the placing in service of a post-heating circuit; this post-heating circuit can be combined with the slow heating circuit Cs. In this case, the amplifier 45 actuates the closing of the working contact of the relay R2 (FIG. 5).

The time during which the plugs b are kept supplied with post-heating may be of the order of 10 to 30 seconds.

FIG. 11 is a diagram showing a modification of an embodiment of the slow pre-heating circuit Cs or of post-heating, according to which the reduction in the voltage applied to the plugs b, instead of being obtained by a drop in voltage through a resistor 2 (FIG. 5) with loss of electrical energy, is obtained by cutting off, in time, the supply of the plugs.

The plugs b are connected in parallel in this emitter circuit of a power transistor 46 of the NPN type. The base of this transistor is connected to the output of an AND gate 47 of which one input 47*a* receives, permanently, square pulses 48 (whose cyclic ratio can be regulated), delivered by a multi-vibrator 49. The frequency of the signals 48 is relatively low on the order of 1 Hz.

Another input 47*b* of the gate 47 is connected to a point of the control circuit on which a state "1" appears when the slow pre-heating or post-heating order is given; for example, this input of the gate 47 may be connected to the output of the amplifier 21 of FIG. 6, and, if necessary, to that of the amplifier 45 of FIG. 10.

When the slow pre-heating or post-heating is placed in operation, the output of the gate 47 will pass periodically to state "1" in synchronism with the signals 48. The transistor 46 will be periodically conductive; the plugs b supplied by a chopped current will be subjected to an average voltage less than that of the battery.

The transistor 46 could be replaced by a GTO thyristor (of which the trigger enables the conduction to be stopped).

FIG. 12 is a modification of the diagram of FIG. 11 in which the transistor 46 actuates the plugs b through a relay 50 whose control winding is connected in the collector circuit of the transistor 46; a working contact of this relay 50 is mounted on the supply circuit in parallel with the plugs b, from the + pole of the battery. This working contact will open and close in synchronism with the signals 48.

FIG. 13 is a diagram designed to introduce a limitation in the time during which the starter is supplied with electrical current on a starting attempt.

The output of the gate 20*a* of FIG. 6 is connected to one input of an AND gate 51 and to the triggering input of the time delay 52. The output of this time delay 52 is connected to another input of the gate 51.

The output of the gate 51 is connected to the amplifier 21.

The output of the time delay 52 passes to state "1" and remains in this state during a pre-determined time, when the output of the gate 20*a* passes to state "1".

As soon as the output of the time delay 52 comes back to state "0", the output of the gate 51 comes back to state "0" and the supply to the starter ceases.

In the absence of such a device, the starter M would risk rotating until the battery is exhausted, notably in the case of an engine of which the pump would have been cleared.

The diagram of FIG. 14 is that of a safety circuit designed to prevent the supply of the starter if the conditions such as the gear lever being in neutral position, the hood being closed, etc. are not fulfilled.

For this, the output of the gate 20*a* shown in FIG. 6, is connected to one input of an AND gate which may be the gate 51 of FIG. 13. Another input of this gate 51 is connected to the safety contacts line which ends at one input of the gate 25 of FIG. 6. The safety switches line only gives state "1" when all the safety conditions are satisfied.

The connection of the safety switches S1, S2 to an input of the gate 25 (FIG. 6) only causes the safety systems to come into play during the period preceding the triggering of the starting sequence.

The device of FIG. 14 or a similr device renders the safety systems operative after the triggering of the starting sequence.

It should be noted, in general, that the different electronic circuits remain, normally, supplied continually with electrical current by the connection 9 (FIGS. 1 and 5) after opening the switches 5 and 4. The various time delays provided in the device are advantageously of the C.M.O.S. integrated circuit type which consume little energy.

There may be provided, in case of cut off of the electrical supply of the electronic circuits, means for restoring all the circuits into the desired states.

In the case where the vehicle includes a diagnosis plug connected to a revolution detector, this detector advantageously forms the detector 8.

To illustrate the above-noted ideas, the following numerical values are given as being representative valves, but they are by no means to be taken as being limiting:

$\theta_o$ of the order of 550° C.

$\theta_d$ of the order of 1200° C.

$\theta_m$ of the order of 1100° C.

$\theta_f$ of the order of 1050° C.

$\Delta$tm of the order of 5 s.

It should be clear that this invention enables a considerable reduction in the pre-heating time of the plugs without incurring any danger of damaging the plugs.

It is clear that it is not indispensable, in certain cases, to provide a special slow pre-heating circuit; the closing of the supply circuit of the starter can suffice to cause the voltage to drop substantially at the terminals of the pre-heating plugs, thus resulting in a slow pre-heating.

We claim:

1. A pre-heating device, for starting an internal combustion engine, of the Diesel type or the like, comprising:

a pre-heating plug, mounted in each cylinder of the internal combustion engine, adapted to be supplied by a source of electrical energy to ensure preheating of a combustion chamber;

a rapid pre-heating circuit which ensures the connection of each pre-heating plug to a relatively high electrical voltage, said rapid pre-heating circuit being normally put into operation from the start of pre-heating;

a slow pre-heating circuit adapted to ensure the connection of each pre-heating plug to a lower electrical voltage after a rapid pre-heating period;

a first delay means;

a means sensitive to the temperature of the internal combustion engine which is connected to said first time delay means whereby the rapid pre-heating period depends on a temperature of the internal combustion engine;

a control means which closes an electrical supply circuit of a starter automatically when the rapid pre-heating circuit is cut off, said control means also being able to close the slow pre-heating circuit when the rapid pre-heating circuit is cut off; and means sensitive to engine speed, adapted to order a stopping of the starter when the internal combustion engine rotates at a sufficient speed.

2. A pre-heating device according to claim 1, further comprising means sensitive to a preceding starting order combined with said control means so as to stop a placing in operation of the rapid pre-heating circuit for a first predetermined time interval which follows an attempt at starting.

3. A pre-heating device according to claim 1, wherein the means sensitive to engine speed is adapted to order a stopping of the slow pre-heating circuit when the internal combustion engine rotates at sufficient speed.

4. A pre-heating device according to claim 1, wherein the means sensitive to engine speed is adapted to order the stopping of the starter and of the slow pre-heating circuit when the internal combustion engine rotates at sufficient speed.

5. A pre-heating device according to claim 2, wherein the means sensitive to a preceding starting order comprises a second time delay means.

6. A pre-heating device according to claim 5, wherein said second time delay means is triggered when a main switch is opened after a starter switch is closed and then opened.

7. A pre-heating device according to claim 6, further comprising a means for avoiding triggering of the second time delay means if there has been closing and then opening of the main switch, without the starter having been closed and then opened, said means for avoiding triggering comprising a flip-flop D and a flip-flop R/S combined.

8. A pre-heating device according to claims 5, wherein the second time delay means, when it is triggered, delivers a first signal which has a pre-determined duration, and said first signal inhibits the rapid pre-heating circuit from being placed in operation while permitting the slow-heating circuit and the starter to be placed in operation.

9. A pre-heating device according to claim 8, further comprising:

a first AND gate having an output which actuates placing the rapid pre-heating circuit into operation, said first AND gate having an input connected to an output of the first time delay means and to an output of a first inverter whose input is connected to an output of the second time delay means; and a second AND gate having an output which actuates placing the slow pre-heating circuit and the starter into operation, said second AND gate having an input being fed by a second signal produced on closing of the starter, said second AND gate also having one input connected to an output of an OR gate, said OR gate having one input connected to the output of the second time delay means and another input connected to an output of a second inverter whose input is connected to the output of the first time delay means.

10. A pre-heating device according to claim 9, further comprising:

a first amplifier and a first relay which are connected to the output of the first AND gate and actuate placing the rapid pre-heating circuit into operation; and a second amplifier and a second relay which are connected to the output of the second AND gate and actuate placing the slow pre-heating circuit and the starter into operation.

11. A pre-heating device according to claim 10, wherein the first and second AND gates further comprise a third input connected to a detector of the engine speed, arranged so as to provide the first signal inhibiting the pre-heating circuit from being placed into operation when the engine rotates at sufficient speed.

12. A pre-heating device according to claim 9, further comprising a memorizing means adapted to memorize a transient closing of the starter and to maintain on the input of the second AND gate an order to place the slow pre-heating circuit and the starter in operation.

13. A pre-heating device according to claim 12, wherein the memorizing means comprises a flip-flop D whose clock input is connected so as to be fed by the transient second signal produced on closing of the starter while an input D of the flip-flop D is connected to an output of a third AND gate having two inputs fed by the second signal at the output of a detector of engine speed and by a third signal appearing on the opening of the main switch, the output of the flip-flop D being connected to an input of the second AND gate.

14. A pre-heating device according to claim 5, wherein the means sensitive to a preceding starting order comprises a means sensitive to the temperature of the pre-heating plug combined with the second time delay means, the pre-heating device being arranged so that the rapid pre-heating circuit is stopped and the slow pre-heating circuit and the starter are actuated, if the temperature of the pre-heating plug reaches or exceeds a value $\theta_0$, or if an interval of time which follows the closing of the starter switch is less than a duration of switch-over of the second time delay means.

15. A pre-heating device according to claim 14, wherein the means sensitive to the temperature of the pre-heating plug comprises a current strength detector which enables a deduction, from current strength which passes through the pre-heating plug fed by the source of electrical energy whose voltage is known, of the temperature of the pre-heating plug.

16. A pre-heating device according to claim 15, wherein an output of the current strength detector is connected, through a flip-flop RS, to an input of a "NOT AND" gate of which another input is connected to the output of the second time delay means, the output of said "NOT AND" gate being connected to an input of a flip-flop of which one output is connected to a zero reset input of the first time delay means.

17. A pre-heating device according to claim 14, wherein when the pre-heating plug is cold, the first time delay means and the rapid pre-heating circuit are triggered on closing of the starter, and when the pre-heating plug reaches the temperature $\theta_0$, at a time $t_0$, the first time delay means are re-triggered so that the pre-heating plug is subjected to rapid pre-heating during a maximum period of time $\Delta t_m$, said time $\Delta t_m$ being determined by the first time delay means from the time $t_0$.

18. A pre-heating device according to claim 17, wherein the current strength detector is arranged to order a change in state of the output of an associated flip-flop, on passage by an absorbed current strength through a value $i_0$ said value $i_0$ corresponding to the temperature $\theta_0$, said change in state actuating re-triggering of the first time delay means.

19. A pre-heating device according to claim 17, further comprising a by-pass circuit for the first time delay means comprising an AND gate, said by-pass circuit enabling the rapid pre-heating circuit to remain in operation.

20. A pre-heating device according to claim 14, wherein the first time delay means is adjusted so as to have a maximum switch-over duration $\Delta t_m$ such that if a pre-heating plug having a temperature equal to $\theta_0$ is subjected during the maximum switch-over duration to the relatively high electrical voltage, at the end of this maximum duration of switch-over, a temperature ($\theta_f$) reached by the pre-heating plug will not harm said pre-heating plug.

21. A pre-heating device according to claim 14, wherein the means sensitive to a preceding starting order further comprises a third time delay means adapted to deliver a switch-over gating pulse of a predetermined duration, and read-out means of a charge of a capacitor through an NTC resistor sensitive to temperature of the internal combustion engine, the rapid pre-heating circuit being stopped and the slow pre-heating circuit and the starter being actuated if voltage at two terminals of the capacitor reaches a predetermined value in a time less than the switch-over gating pulse of the third time delay means.

22. A pre-heating device according to claim 21, wherein the read-out means of a charge of the capcitor comprises a comparator adapted to compare the voltage at the terminals of the capacitor with a reference voltage, an output of this comparator being connected to an input of a NOT AND gate whose other input is connected to the output of the third time delay means.

23. A pre-heating device according to claim 21, wherein duration of said switch-over gating pulse of the third time delay means is substantially of the order of 0.5 seconds.

* * * * *